US007075066B2

(12) United States Patent
Bailey et al.

(10) Patent No.: US 7,075,066 B2
(45) Date of Patent: Jul. 11, 2006

(54) APPARATUS AND METHODS FOR ELECTROSPRAY APPLICATIONS

(75) Inventors: Michael L. Bailey, Oak Harbor, WA (US); Thomas J. Lini, Coupeville, WA (US)

(73) Assignee: Upchurch Scientific, Inc., Oak Harbor, WA (US)

( * ) Notice: Subject to any disclaimer, the term of this patent is extended or adjusted under 35 U.S.C. 154(b) by 45 days.

(21) Appl. No.: 10/858,127

(22) Filed: Jun. 1, 2004

(65) Prior Publication Data

US 2005/0023455 A1 Feb. 3, 2005

Related U.S. Application Data

(60) Provisional application No. 60/474,007, filed on May 29, 2003.

(51) Int. Cl.
*H01J 49/00* (2006.01)

(52) U.S. Cl. ..... 250/288; 250/282; 250/281

(58) Field of Classification Search ..... 250/288, 250/282, 281

See application file for complete search history.

(56) References Cited

U.S. PATENT DOCUMENTS

| | | | | |
|---|---|---|---|---|
| RE34,757 | E * | 10/1994 | Smith et al. | 204/452 |
| 6,410,915 | B1 * | 6/2002 | Bateman et al. | 250/288 |
| 6,753,521 | B1 * | 6/2004 | Park et al. | 250/282 |
| 2001/0007641 | A1 * | 7/2001 | Jovanovich et al. | 422/99 |
| 2004/0261522 | A1 * | 12/2004 | Dykas et al. | 73/273 |

* cited by examiner

*Primary Examiner*—Nikita Wells
*Assistant Examiner*—Anthony Quash
(74) *Attorney, Agent, or Firm*—Vinson & Elkins L.L.P.

(57) ABSTRACT

A device and methods are provided, the device comprising a conductive union disposed in a conductive holder, a first fitting capable of coupling with the holder and fluidly communicating with the conductive union, and a spray tip disposed in the fitting and communicating with the conductive union along an axis. The device also comprises a ferrule and fitting capable of coupling with a second holder and communicating with a second conductive union, a tube disposed in the ferrule and fluidly communicating with the first conductive union and the spray tip along the axis. The assembly also includes an insulating member removably secured to the first and second conductive unions to electrically insulate them when they are electrically connected to first and second voltage levels, respectively.

24 Claims, 9 Drawing Sheets

APPARATUS AND METHODS FOR ELECTROSPRAY APPLICATIONS

CLAIM OF PRIORITY

This application claims priority to U.S. Provisional Patent Application Ser. No. 60/474,007, filed May 29, 2003, which is hereby incorporated herein by reference.

FIELD OF THE INVENTION

This invention relates to apparatus and methods regarding their use that are useful in electrospray applications and other techniques used in analytical systems and methods, such as liquid chromatography and mass spectrometry. More specifically, the invention relates to a conductive junction assembly useful in applying a voltage to a liquid stream for electrospray applications.

BACKGROUND OF THE INVENTION

Electrospray techniques may be used for analysis of sample solutions in applications and systems, such as liquid chromatography (LC) and mass spectrometry (MS). In such techniques, a sample solution (such as the effluent from a LC system) may be atomized by an electrospray device and then analyzed with a mass spectrometer. Such techniques are also often used for analysis of biological specimens or samples.

Electrospray generally refers to methods in which electrical charges are provided to a liquid or effluent and are used to generate a very fine aerosol of the effluent. Conventional electrospray techniques used in analytical applications involve different apparatus. In one conventional approach, a sharply pointed or tapered hollow tube (such as a syringe needle) can be used. A high voltage power source can be attached to the tube so that when the effluent is pumped through the tube, the effluent sprays out of the end in a very fine aerosol form. The droplets of the effluent aerosol then fly towards the counter electrode used as the collector for analysis. In some conventional alternatives, the voltage is introduced by passing the effluent through a spray tip tube which is coated with a conductive material (such as metal or graphite) at or near the exit orifice and then the coating of the tube is connected to a voltage source. One problem with this approach is the gradual ablation of the coating material through coronal discharge, such that the coating becomes less effective and the spray may become more erratic. A coated spray tip is also more expensive than one that is not coated with a conductive material.

One example of electrospray techniques and devices is described in U.S. Pat. No. 5,572,023, issued Nov. 5, 1996, to Caprioli, which is incorporated by reference herein. Caprioli describes the use of an electrically charged capillary spray needle. Before passing through the needle, the effluent in Caprioli passes through a steel fitting connected to a voltage source to add an electric charge to the fluid solution. The fluid then passes from the fitting through the non-conductive needle. In practice, this approach introduces additional dead volume into the system in the fitting and requires that the fitting used to introduce the charge to the fluid stream must be upstream of the needle.

Another example of apparatus and methods for electrospray applications is described in U.S. Pat. No. 4,842,701, which issued Jun. 27, 1989, to Smith et al., and which is hereby incorporated by reference herein. Smith describes the use of electrospray applications for chemical analysis of samples.

Nanospray applications involve the use of smaller sample sizes and volumes of solution to be analyzed. In such applications, the flow rate of the effluent is typically on the order of five (5) nanoliters per minute or so or even less. Such nanospray applications require that voltage be introduced into an effluent stream, which is complicated by the fact that microfluidic applications used a closed system for fluid delivery that is of the smallest practical internal volume. The point at which the voltage source is applied to the effluent stream is commonly referred to as the "liquid junction." In addition, the reduced size of such samples is typically one or more orders of magnitude from more traditional electrospray applications, thus making it more difficult to provide accurate and precise apparatus which is not overly delicate and subject to breaking.

One conventional method for applying voltage to the effluent stream is to include a "Tee" type component or junction whereby the third port secures and suspends a conductive wire. This additional component increases the internal volume of the system, thereby degrading the performance of the analysis. Furthermore, the suspended wire in such conventional applications often introduces turbulence into the fluid flow, and thereby interferes with the direct, laminar flow of the effluent, causing undesirable delay.

Maintenance of such a conventional liquid junction often includes the replacement of the entire component or junction when it becomes clogged or when the conductive wire degrades to the point of inefficacy. This replacement usually involves disassembly of fittings and tubing, and thus can require a significant amount of labor and time.

An example of the use of a slightly different junction is found in U.S. Pat. No. 5,587,582, issued Dec. 24, 1996, to Henion et al., which is hereby incorporated by reference herein. Henion describes the use of a "T" shaped junction to introduce the charge to the fluid stream. In Henion, a T-shaped junction is provided by which a fluid from a capillary electrophoresis system is introduced to a capillary tube with a needle at the other end. At the junction of these two capillary tubes, a third tube introduces a solvent to the junction. The electrical charge is provided by attaching an electrode to the distal end of the tube with the needle. The assembly of Henion requires precise alignment and configuration of the tubes in order to minimize dead volume, as well as potential introducing turbulence into the fluid flow.

Still another approach is the use of a fractured tube for creating the spray. In U.S. Pat. No. 6,140,640, issued on Oct. 31, 2000 to Wittmer et al., the use of such a tube is described. In Wittmer, which is hereby incorporated by reference herein, a fracture is provided in the non-conductive tube, with the fracture located at a selected location from the needle or exit orifice of the tube, and a collar surrounds the tube near the fracture. The voltage is introduced to the fluid by means of a wire or electrode located near the fracture.

Such conventional approaches typically involve a number of difficulties. Fracturing a tube obviously weakens it and locating a fracture close enough to the needle and the wire to introduce a charge to the stream can require significant effort and delays. Conventional approaches using a T-shaped junction often involve undesirable dead volumes in the system, and can still require significant amounts of time for maintenance and replacement. Still other difficulties arise from the locations of the wires or electrodes used to apply the voltage to the stream in such conventional applications. It is undesirable to have exposed wires which can pose safety hazards or allow arcing.

SUMMARY OF THE INVENTION

The present invention provides apparatus and methods for use of a conductive junction assembly to introduce an electrical charge to a fluid stream. In one embodiment, an assembly consisting of a column holder, a "hot" union, a "ground" union, and conductive holders for the unions, is used to removably attach a tube for carrying a fluid stream to a fused silica capillary tube located in an electrically insulating member between the hot union and the ground union, and to a needle-tipped tube for providing a spray of the fluid, with an electrical voltage capable of being applied to the fluid via the hot conductive union and a ground voltage applied to the fluid via the ground conductive union. In one embodiment, a column can be provided by packing the fused silica capillary tube with appropriate materials. In one embodiment of the invention, a method of providing an electric voltage to an effluent fluid stream for an electrospray application is provided. "Hot" as used herein has its usual and ordinary meaning in this context (i.e., that component has a voltage applied).

It is an object of the invention to provide a novel assembly for applying a voltage to a fluid used in electrospray applications.

It is another object of the invention to provide an assembly which allows an operator to easily connect tubing from a first system to tubing for providing an electrospray and providing an electric charge to the fluid.

It is another object of the invention to provide an assembly for introducing an electric voltage to a fluid for electrospray applications which can be easily maintained.

It is still another object of the invention to provide an assembly for introducing an electric voltage to a fluid for electrospray applications which minimizes the dead volume, if any, introduced in the system.

These and other objects and advantages of the invention will be apparent from the drawings and the following detailed description to those skilled in the art.

DETAILED DESCRIPTION OF THE INVENTION

Figure 1:
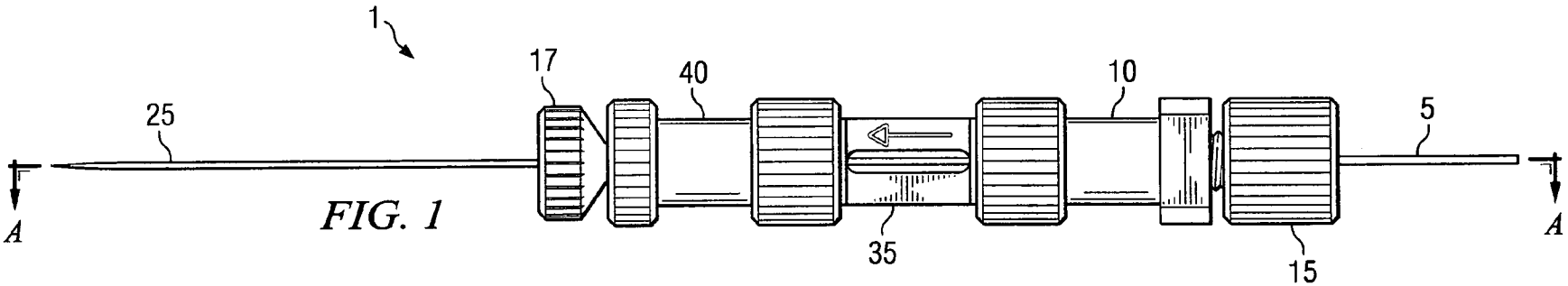
FIG. 1 is a drawing showing the assembly of one embodiment of the present invention as connected.

A conductive union assembly 1 as shown, for example, in FIG. 1, provides a novel solution by creating a non-invasive method to apply voltage to a flowing stream. This conductive union assembly 1 has a significantly smaller internal volume that a conventional liquid junction and does not introduce the turbulence caused by suspending a wire in the fluid stream as in conventional liquid junctions. Voltage may be applied to the conductive holder 40 in the assembly 1 by various means, which in turn transmits the voltage to the fluid flowing through the assembly 1. The conductive union 22 is easily replaceable in comparison with traditional methods and does not require the use of threaded fittings to hold a voltage wire. This method of applying voltage using a conductive union 22 allows the assembly 1 to adapt readily to diverse fluid delivery systems. Furthermore, a column can be connected directly to the fluid system via the conductive union assembly 1. This direct connection produces an assembly with the lowest possible internal volume.

As shown in FIG. 1, an assembly 1 is provided, the assembly 1 comprising a conductive union 20, a first fitting 15 capable of coupling with the holder 10 and communicating with the conductive union 20, and a tube 25 disposed in the first fingertight fitting 15 and communicating with the conductive union 20 along an axis. The assembly 1 also comprises a ferrule 27 capable of coupling with the holder 10 and communicating with the conductive union 20, and a microbore tube 5 disposed in the ferrule 27 and communicating with the conductive union 22 and the tube 25 along the axis. The assembly 1 also comprises a second fitting 17 capable of coupling with the union 22 to allow fluid communication between tube 25 and the fused silica capillary tube 30, the second fitting 17 having the microbore tube 25 disposed therein along the axis.

As shown in FIG. 1, the tube 25 has a distal end which is tapered. This is done to provide a spray of the fluid when ejected from the distal end of tube 25. The tube 25 may of a conventional fused silica type that is commercially available, such as those commercially available for electrospray applications from New Objective, Inc. of Woburn, Mass. In addition, the assembly 1 includes an insulator 35, located between the holder 10 and a second holder 40. The fitting 17 is provided to removably and sealingly secure the tube 25 within the assembly 1.

Figure 2:
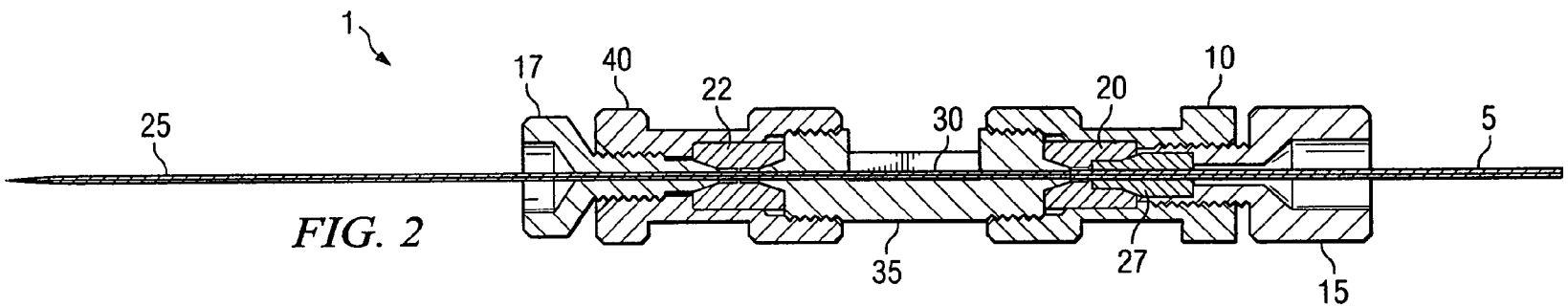
FIG. 2 is a sectional view along line A—A of the assembly shown in FIG. 1.

Referring now to FIG. 2, a sectional view of the assembly 1 is provided along line A—A of FIG. 1. (The same numbers are used for various components in the various drawings for ease of reference.) As shown in FIG. 2, the assembly 1 also includes ferrule 27 and conductive union 20. In FIG. 2, the tube 5 is removably secured in a sealed fluid connection with fused silica capillary tube 30. The fitting 15 allows an operator to secure the tube 5 in place by tightening the fitting 15, thereby forcing the ferrule 27 and tube 5 adjacent to a first end of the union 20. This allows the operator to easily provide a secure and sealing connection allowing fluid communication from the passageway in the tube 5 to one end of the tube 30. Tube 30 is a fused silica capillary tube with an internal diameter of 50 microns or so, although those skilled in the art will appreciate that tube 30 may be made of other materials and sizes.

As shown in FIGS. 1 and 2, the holder 40 and union 22 can be described as "hot." In one embodiment, an electrical voltage (such as +3,000 volts DC) is applied to holder 40 by any conventional means. For example, insulated clamps may be used to safely and removably attach wires to the holder 40 from a voltage source so that the operator need not touch the wires, clamps, or holder 40. I prefer to use fuse clips for providing an electric potential from a voltage source (including a voltage of 0 volts or ground) to holders 10 and 40, such as fuse clips which are commercially available from Cooper Industries, Bussman Division, of St. Louis, Mo. Such fuse clips can be of a selected size which can be securely attached by an operator to the holders 10 and 40, yet can be easily manually removed by an operator. Such fuse clips can be made of various materials, including beryllium copper. At the same time, the union 20 is grounded, such as by electrically connecting the holder 10 to a device which is electrically grounded. In one embodiment, the holder 40 and union 22 are made of 316 stainless steel. Similarly, holder 10 and union 20 are made of 316 stainless steel. While other conducting metals may be used, 316 stainless steel is advantageous for a number of reasons, including conductivity, durability, and because it is relatively inert to biological materials, thus making assembly 1 biocompatible. In addition, the insulator 35 is made of polyethereketone (PEEK), as are fittings 15 and 17 and ferrule 27. Those skilled in the art will appreciate that various voltages can be used, depending on the solvent and sample used in a particular application. Typically, the voltages used with assembly 1 are in the range of from about +3,000 volts DC or so to about +8,000 volts DC or so.

Figure 3A:
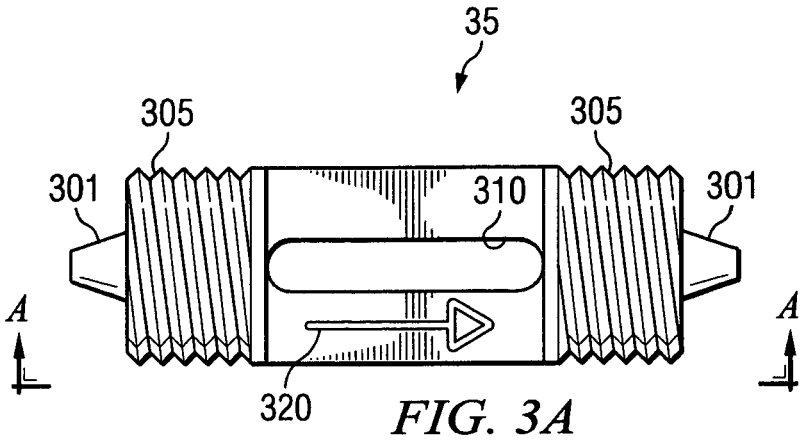
FIGS. 3A, 3B, 3C, 3D, 3E, 3F, and 3G are drawings of additional views of a column holder useful in one embodiment of the present invention.
Figure 3B:
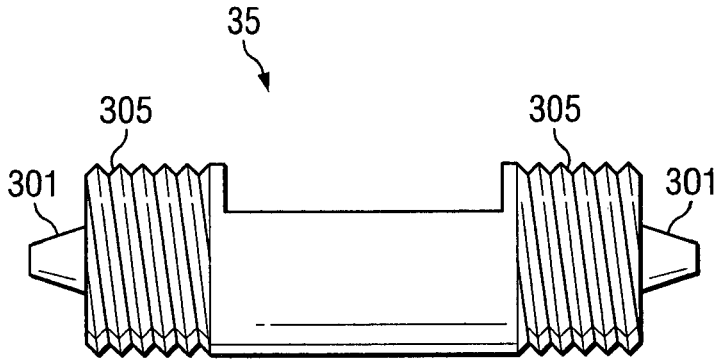
Figure 3C:
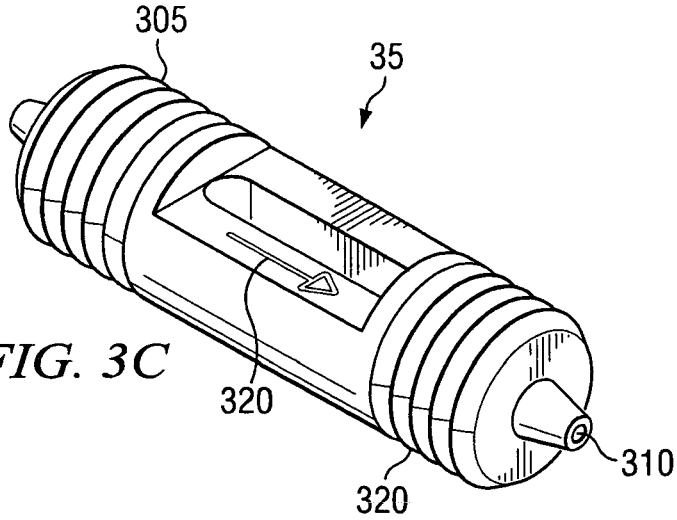
Figure 3D:
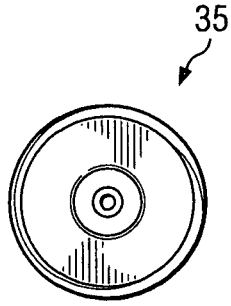

Referring now to FIGS. 3A though 3G, additional views of the insulator 35 are provided. As shown in FIG. 3A, the insulator 35 has two ends, each of which has a protruding portion 301. The portions 301 are conically shaped to taper to a narrower diameter. Between the portions 301 at each end of the insulator 35 and the main body portion of insulator 35 are threaded portions 305. As shown in FIGS. 3A, 3B, and 3C, the threaded portions 305 are provided on the outside of the insulator 35. As also shown in FIG. 3A, the main body portion of insulator 35 has a groove 310 provided to allow an operator easier access to a tube 30 when disposed within the interior of the insulator 35. The main body portion of the insulator 35 also includes a visible arrow symbol 320 located on the outside so that it is easily observed by an operator. The arrow 320 allows the operator to quickly and easily determine the appropriate orientation of the insulator 35 with respect to the fluid flow of the system when the insulator 35 is connected as shown in assembly 1, for example.

Figure 3E:
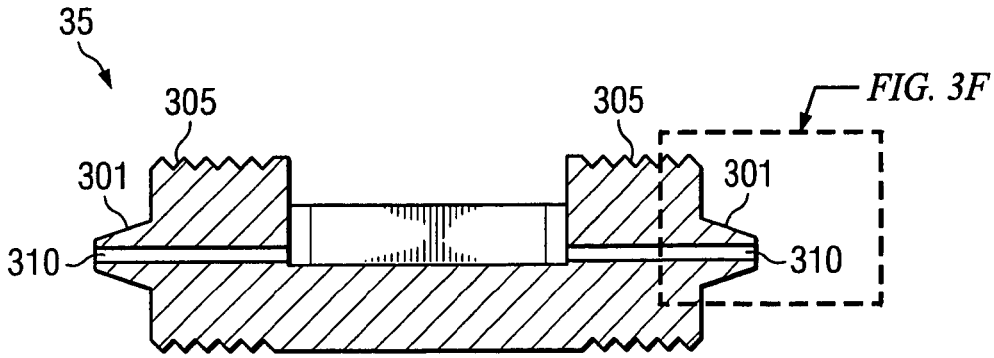
Figure 3F:
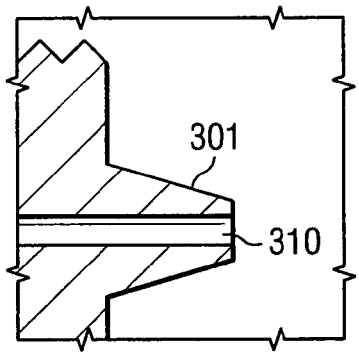
Figure 3G:
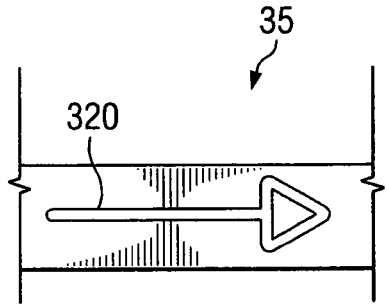

Referring now to FIG. 3E, a sectional view of the insulator 35 along line A—A of FIG. 3A is provided. As shown in FIG. 3E, the insulator 35 has passageways 310 extending from each end of the insulator 35 to the interior portion of the main body of the insulator 35. The passageways 310 are each adapted to receive tubing, such as tube 30, to allow fluid communication through the insulator 35. In the embodiment shown in FIGS. 1 and 2, a fused silica capillary tube 30 extends through the insulator 35, including passageways 310. As shown in FIG. 2, a portion of the ends of the tube 30 extend beyond the conical ends 301 of the insulator 35. Those skilled in the art will appreciate, however, that the tube 30 can be of a size such that no portion of the tube 30 extends from either of the ends of the insulator 35. For example, those skilled in the art will appreciate that the insulator 35 could have inwardly tapered recesses (not shown) to receive tubing and a fitting or fitting/ferrule combination. The tube 30 can contain a packing material (not shown) so that the tube 30 serves as a column. The tube 30 can contain any one of a number of packing materials, such as C18 phase material disposed within a capillary sample trap column, which is commercially available from Upchurch Scientific of Oak Harbor, Wash. Those skilled in the art will understand and appreciate that any one of a number of different materials may be used in tube 30 to provide a column with the desired properties, depending on the solvent and samples to be analyzed in a particular application.

Figure 4A:
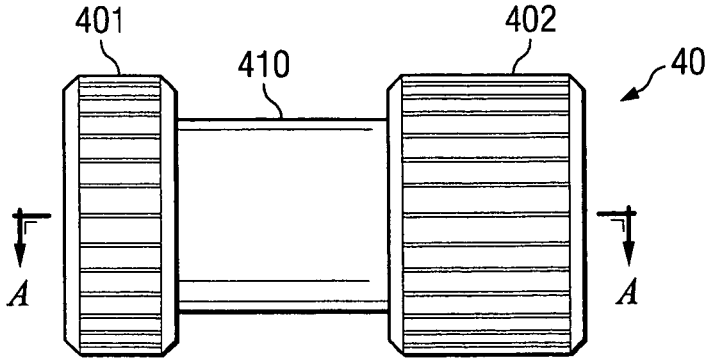
FIGS. 4A, 4B, and 4C are drawings of additional views of a "hot" junction useful in one embodiment of the present invention.
Figure 4B:
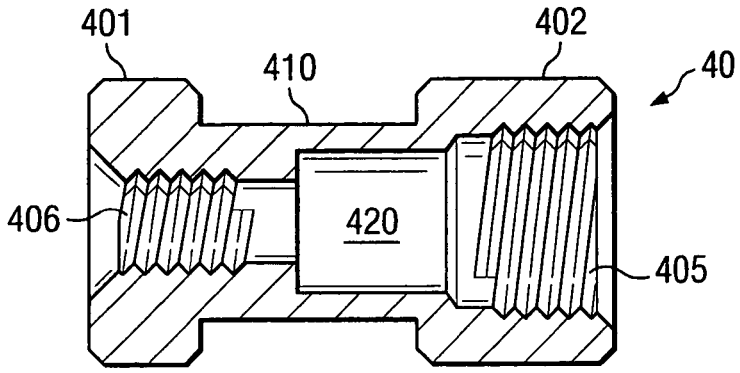
Figure 4C:
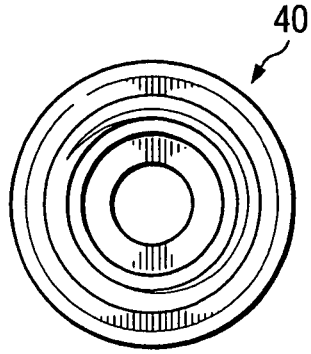

Referring now to FIGS. 4A, 4B, and 4C, additional views of the "hot" junction 40 are provided. FIG. 4B is a sectional view of the junction 40 taken along line A—A of FIG. 4A. As shown in FIGS. 4A and 4B, the junction 40 has two ends 401 and 402. One end 401 is provided with a coarse knurl in order to allow the operator to grip and turn the junction 40 more easily. The junction 40 also has a main body portion 410. As shown in FIG. 4B, the junction 40 has an interior portion with a passageway extending through the entire body of junction 40 and through both ends 401 and 402 of the junction 410. The junction 410 also has an interior portion 420 adapted to receive a conductive union 22, such as is shown in FIG. 2 for example. As also shown in FIG. 4B, the junction 40 has threaded interior portions 405 and 406. The threaded portions 405 and 406 are adapted to securely receive and hold, respectively, a portion of one end portion 305 of the insulator 35, and a portion of fitting 17, as is shown for example in FIG. 2. The use of threaded portions 405 and 406 make it easier for an operator to assemble the assembly 1, and also make it easier for an operator to dissemble assembly 1, such as is needed when the tube 30 needs to be replaced or when a portion of assembly 1 becomes partially or completely clogged.

Figure 5A:
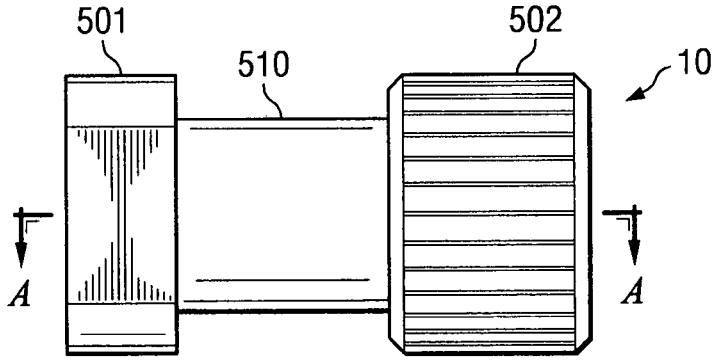
FIGS. 5A, 5B, 5C, and 5D are drawings of additional views of a "ground" junction useful in one embodiment of the present invention.
Figure 5B:
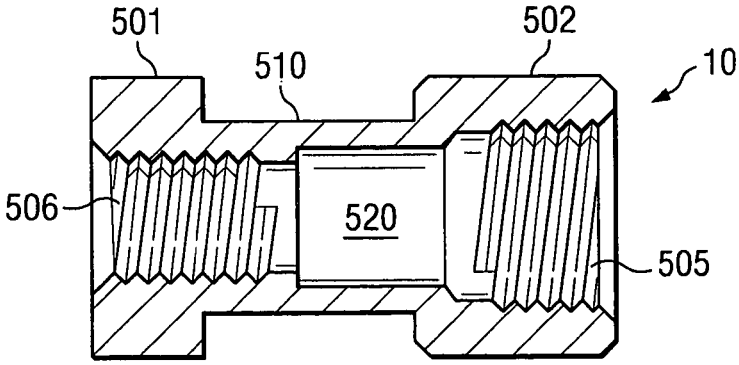
Figure 5C:
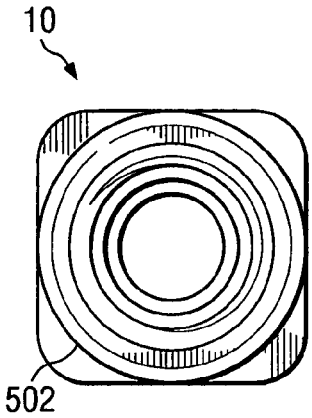
Figure 5D:
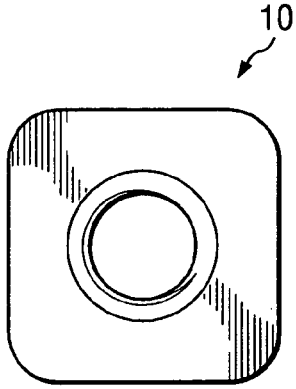
Figure 6A:
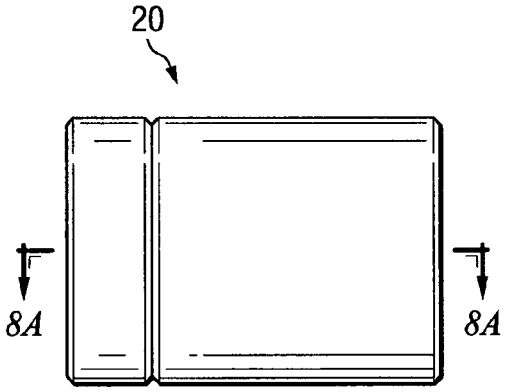
FIGS. 6A, 6B, 6C, and 6D are drawings of additional views of a conductive union useful in one embodiment of the present invention.
Figure 6B:
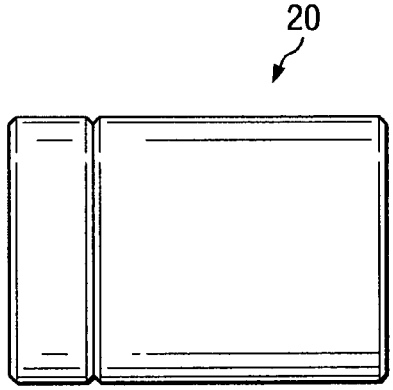
Figure 6C:
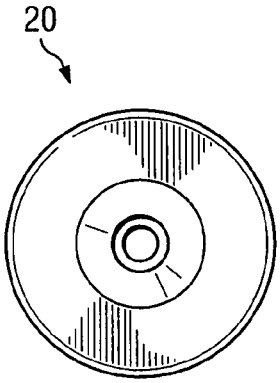
Figure 6D:
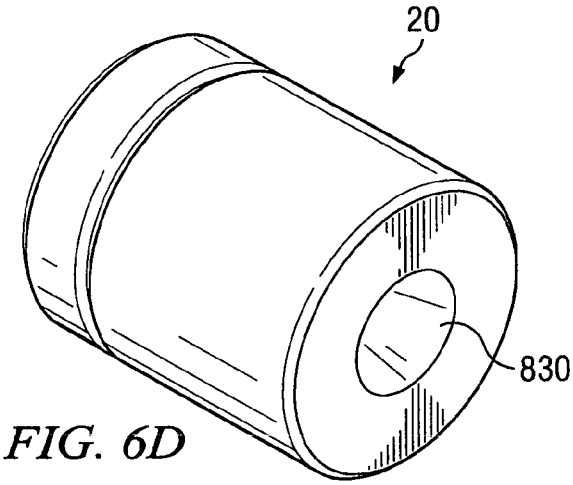

Now referring to FIGS. 5A through 5D, additional views of the holder 10 are provided. FIG. 5B is a sectional view of the holder 10 taken along line A—A of holder 10 as shown in FIG. 5A. As shown in FIGS. 5A and 5B, the holder 10 has a first end portion 501, a main body portion 510, and a second end portion 502. The holder 10 also includes an interior passageway extending the entire length of the body of holder 10. Holder 10 further has internally threaded portions 505 and 506. The internally threaded portions 505 and 506 are adapted to securely and removably be attached to, respectively, one end 305 of the insulator 35 and a fitting 15, as is shown for example in FIG. 2. The passageway extending through holder 10 includes an interior portion 520 adapted to receive and hold a conductive union 20, as is shown for example in FIG. 2. The passageway is further adapted to allow for a sealing connection between an end of the tube 30 and an end of tube 5 when assembly 1 is assembled, as is shown in FIG. 2 for example. As is shown in FIG. 1, the end 502 of the holder 10 may have a coarse knurled portion for allowing an operator to more easily grip and turn the holder 10 in order to assemble or dissemble the assembly 1. As with junction 40, the holder 10 is made of 316 stainless steel in one embodiment of the invention. As noted above with respect to the junction 40, 316 stainless steel is useful for a number of reasons, including its conductivity, durability and biocompatibility.

In FIGS. 6A through 6D, additional views of the conductive union 20 are shown. The conductive union 20 has a passageway extending therethrough to allow fluid communication between one end of tube 5 and one end of tube 30, as is shown in FIG. 2 for example. Union 20 is made of 316 stainless steel in one embodiment of the invention. The 316 stainless steel has advantages due to its durability, conductivity, and also its biocompatibility. Although not shown, it is to be appreciated that the passageway of union 20 can be electroplated with other conductive metals, such as gold, platinum or the like. If desired, the entire union 20 can be plated with gold, platinum or another selected conductive material.

Figure 7A:
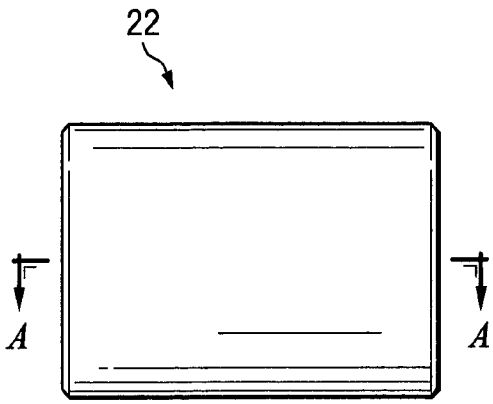
FIGS. 7A, 7B, 7C, 7D, 7E, and 7F are drawings of additional views of a conductive union useful in one embodiment of the present invention.
Figure 7B:
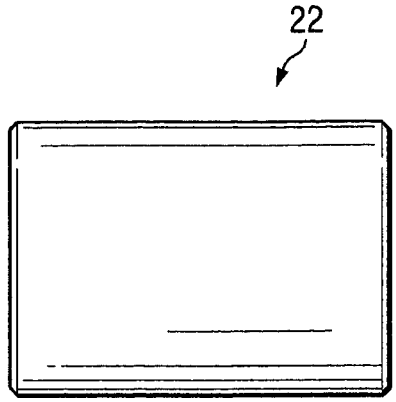
Figure 7C:
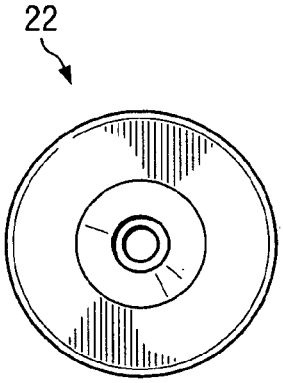
Figure 7D:
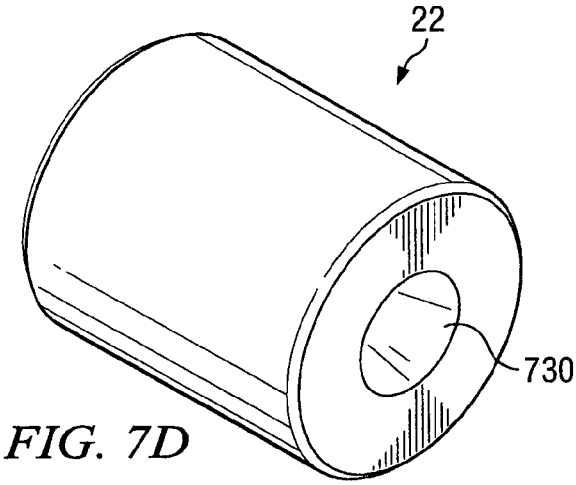
Figure 7E:
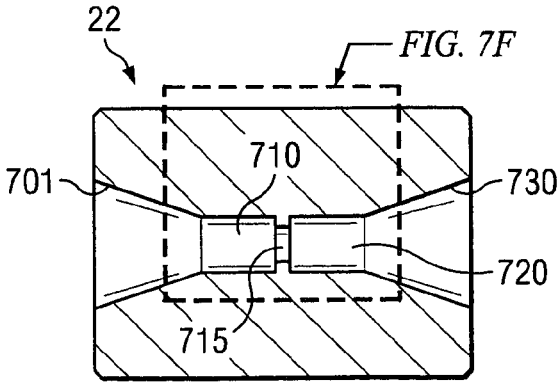
Figure 7F:
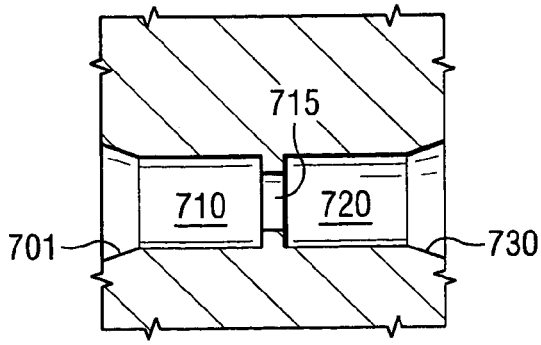

Referring now to FIGS. 7A through 7F, additional views of the union 22 are provided. FIG. 7E is a sectional view of the union 22 taken along line A—A of FIG. 7A. As with the union 20, union 22 has a passageway extending there though. The passageway is provided to allow fluid communication between one end of tube 30 and one end of a tube 25, as is shown for example in FIG. 2 when assembly 1 is assembled. As with union 20, the union 22 is made of 316 stainless steel, although it can be plated with or made of other conductive materials, such as gold, titanium, platinum or other materials as desired. As shown in FIG. 7E, the union 22 has a tapered internal portion 701 at one end, and a tapered internal portion 730 at the other end. The tapered portions 701 and 730 are adapted for removable sealing connections with, respectively, one end of a fitting 17 and one end 301 of the insulator 35. The union 22 further has interior portions 710 and 720, which are adapted for removably holding in a sealing connection, respectively, one end of tube 25 and one end of tube 30, as is shown for example in FIG. 2 when the assembly 1 is assembled. The interior portion 715 allows fluid communication between the tube 30 and the tube 25 so that they need not contact one another. The interior portion 715 can be provided with an ultra-low volume, such as around 10–15 nanoliters or so, in order to minimize the amount of dead volume. FIG. 7F provides a detailed view of the interior portions 710, 715 and 720 of the union 22. As shown in FIG. 7F, the width of interior portion 715 is about 1/100th of an inch.

Figure 8A:
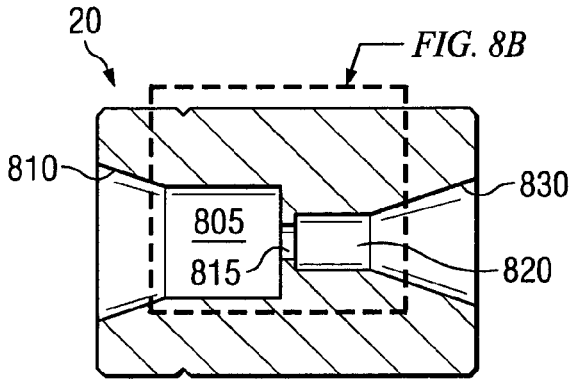
FIGS. 8A and 8B are additional views of a conductive union useful in the present invention and shown in FIGS. 6A–6D.
Figure 8B:
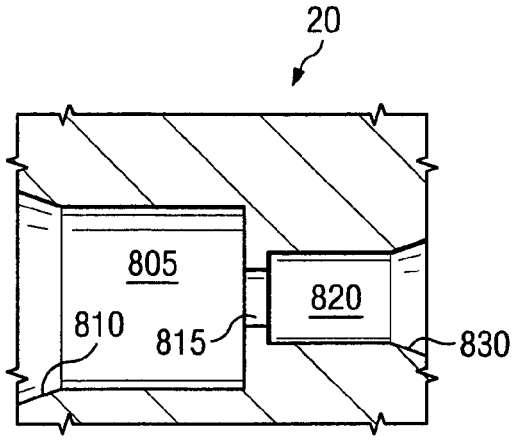

Now referring to FIGS. 8A and 8B, additional detail regarding union 20 is shown. FIG. 8A provides a cross-sectional view of the union 20. As shown in FIG. 8A, the union 20 has internal tapered portions 810 and 830. In addition, union 20 has interior portions 805, 815, and 820, which are adapted to receive and hold in a secure and sealing relationship a fitting (not shown) and one end 301 of the insulator 35. The interior portions 805, 815, and 820 allow for fluid communication through the union 20 with a minimum of dead volume and with a minimum of any added turbulence in the fluid flow.

Those skilled in the art will appreciate that, although not shown herein, the union 20 can be provided with an interior configuration identical or similar to that shown and described with respect to union 22. In addition, those skilled in the art will understand and appreciate that the interior portions of unions 20 and 22 can be varied to be adapted to receive and securely and sealingly hold ferrules and/or fittings with shapes other than those shown and described herein, such as those shown in FIG. 2.

Figure 9:
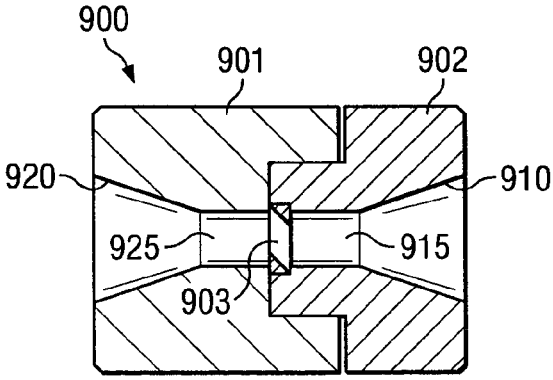
FIG. 9 is a sectional view of an alternative embodiment of a conductive union useful in an alternative embodiment of the present invention.

Referring now to FIG. 9, a sectional view of an alternative conductive union 900 is provided. As shown in FIG. 9, the union 900 comprises a first member 901 and a second member 902 which are adapted to securely mate with one another. Each of the members 901 and 902 have passages therethrough to allow fluid communication therethrough. As shown in FIG. 9, each of the members 901 and 902 has a tapered interior portion 920 and 910, respectively, for allowing a tube (not shown) and a fitting (or a combination of a ferrule and a fitting) (not shown) to be removably attached thereto. In addition, each of the members 901 and 902 has interior passages 925 and 915, respectively. Also shown in FIG. 9 is a frit 903. The frit 903 can be of a conventional type, and those skilled in the art will appreciate that the frit 903 is to be held securely within a recess or seat in either member 901 or 902. The frit 903 can be made of an appropriate material, which is usually selected based on the nature and qualities of the effluent and the samples to be analyzed. The frit 903 is made of a permeable or porous material, such as sintered stainless steel or titanium, and allows the effluent to pass therethrough while providing a filtering function. In one embodiment, the member 901 is made of 316 stainless steel so that, when the effluent passes through passage 925, the voltage provided to member 901 is also provided to the effluent. In addition, the member 902 is made of an insulating material, such as polyetheretherketone. The frit 903 is made of a conducting metallic material so that the voltage applied to member 901 is also applied to the frit 903 and, when the effluent passes through the frit 903, to the effluent as well. The frit 903 can be pressed into a seat in member 902 adapted to receive the frit 903.

Referring now to FIGS. 1 and 2, the assembly and disassembly of the assembly 1 are described in more detail. To assemble the assembly 1 for use with electrospray applications, an operator will need to connect the tube 5 to an effluent source. Those skilled in the art will understand that tube 5 can be connected by conventional means to a liquid chromatography system or other systems for analytical applications, or can be connected to a source such an injection valve of any conventional type. The operator then places the free end of tube 5 (assuming that the operator has already connected the other end of the tube 5 to an effluent source—those skilled in the art will appreciate that the operator can first assemble the assembly 1 before connecting one end of tube 5 to the effluent source) through the passageways in a fitting 15 and a ferrule 27. Those skilled in the art will appreciate that the fitting 15 and ferrule 27 can be of different types and materials; for best results, I prefer the F-331-01 and F-113, respectively, which are commercially available from Upchurch Scientific of Oak Harbor, Wash. Similarly, I prefer to use the F-124S fitting for fitting 17; the F-124S is also commercially available from Upchurch Scientific of Oak Harbor, Wash.

Still referring to FIG. 2, the operator places the union 20 within the recess therefor in union 10. The operator then places the second end (i.e., the end away from tube 5 as shown in FIG. 2) of the union 20 against a first end of the insulator 35. As shown in FIG. 2, the second end of the holder 10 and the first end of the insulator 35 have threaded portions adapted to engage one another. By inserting union 20 into holder 10 and attaching the second end of the holder 10 to the first end of the insulator 35 and then turning the holder 10 relative to the insulator 35 (or the insulator 35 relative to the holder 10), the operator can engage the threaded portions so that the holder 10 and insulator 35 are securely attached to allow fluid communication between the first end of the tube 30 and the interior passage of the union 20.

The operator then places the combination of the tube 5, ferrule 27 and fitting 15 into a first end of a holder 10 which is adapted to receive such a combination. After the end of tube 5 is placed against a first end of the union 20 located within the interior of the holder 10, the operator then simply turns the fitting 15 in order to engage the threaded portions of the fitting 15 with those of the holder 10. By turning the fitting 15 relative to the holder 10, the operator screws the fitting 15 into place and forms a sealed connection allowing fluid communication from the tube 5 to the interior passageway of union 20.

Similarly, the operator may complete the assembly 1 by placing one end of the tube 25 through the fitting 17 and, after placing the end of the tube 25 securely against a seat of the union 22, turning the fitting 17 so that the threaded portions of the fitting 17 engage the threaded portions of the holder 40. By turning the fitting 17 relative to the holder 40, the operator is able to securely attach the end of the tube 25 to the union 22. Similarly, the operator can secure a second end of the insulator 35 to the holder 40 by placing the second end of the tube 30 adjacent to the other end of the union 22 and then turning the holder 40 relative to the insulator 35 so that the threaded portions of the holder 40 and insulator 35 engage each other. As noted, an operator may prefer to first connect the second end of the insulator 35 to the first end of the holder 40 before connecting the tube 25 and fitting 17 to the second end the holder 40.

When the operator wishes to disassemble the assembly 1, the operator can easily do so. For example, if the operator wishes to connect the assembly 1 to a different effluent source, the operator can simply turn fitting 15 to loosen it so that the operator can remove the combination of the tube 5, fitting 15 and ferrule 27 from the holder 10. The operator can do so without disassembling the remainder of the assembly 1. The operator can then easily attach the remainder of the assembly 1 to a different effluent source. Alternatively, if the tube 30 is packed with a material so that it serves as a column, and the tube 30 becomes clogged or its performance has degraded over time, the operator can quickly and easily disassemble assembly 1 by turning holder 10 relative to insulator 35 to disengage the threaded portions of holder 10 and insulator 35 so that holder 10 can be easily detached from insulator 35. Similarly, the operator can turn holder 40 relative to insulator 35 to disengage the threaded portions of insulator 35 and holder 40 so that holder 40 can be easily detached from the insulator 35. The operator can then simply reattach the holders 40 and 10 to a new insulator 35 without the need for disconnecting the tube 25 from the holder 40 or the tube 5 from the holder 10. By doing so, the operator can much more easily and quickly replace the tube 30. Similarly, if the tube 25 breaks or needs to be replaced for any reason, the operator can simply turn the fitting 17 relative to the holder 40 to disengage the threaded portions of the fitting 17 from the threaded portions of the holder 40 and remove the fitting 17 and tube 25 from the holder 40. A new tube 25 can then be quickly and easily reattached by placing the new tube 25 through the fitting 17, placing the non-tapered end of the tube 25 against the second end of the union 22 in the holder 40, and then turning the fitting 17 relative to the holder 40 so that its threaded portions engage the threaded portions of the holder 40.

Figure 10:
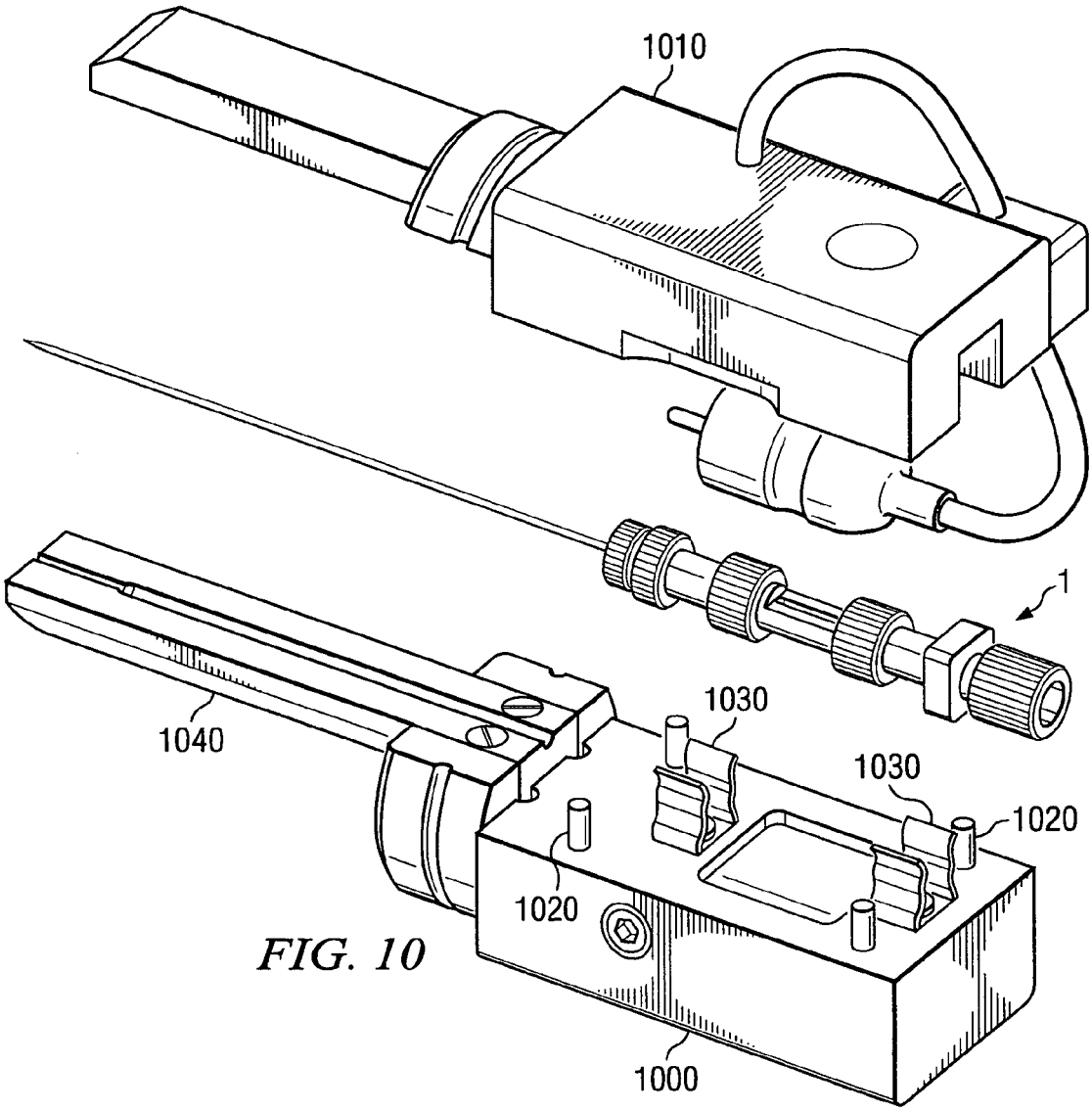
FIG. 10 is an exploded view of an alternative embodiment of the present invention.

Referring now to FIG. 10, an exploded view of an alternative embodiment of the invention is provided. In FIG. 10, the assembly 1 is shown between two opposing members 1000 and 1010. Each of the bodies of members 1000 and 1010 are adapted to receive and hold at least a portion of the assembly 1 (when it is assembled). The members 1000 and 1010 are made of PEEK in one embodiment. Each of the members 1000 and 1010 also has one end with an elongated portion 1040 which has a recess therein to receive the tapered tube 25. In addition, member 1000 includes two fuse clips 1030 located on the face opposing member 1030. As noted above, the fuse clips 1030 are of a selected size and conductive material so that they can receive and securely hold the holders 10 and 40 of the assembly 1 in place. The fuse clips 1030 can be selected so that an operator can easily and quickly snap the assembly 1 into place with respect to member 1000 by snapping the holders 10 and 40 into the corresponding fuse clips 1030.

In addition, FIG. 10 shows that the member 1000 has guiding pins 1020 located on the face opposing member 1010. The face of member 1010 opposing member 1000 can be provided with openings or recesses located in appropriate places to receive and hold the pins 1020 of member 1000. The pins 1020 thus allow an operator to connect the two members 1000 and 1010 without the need for careful measurement each time and the pins 1020 further secure the two opposing members 1000 and 1010 in appropriate position relative to one another. As shown in FIG. 10, the top member 1010 further includes an extension cord adapted for connection to a voltage source. Although not shown, those skilled in the art will appreciate that one of the fuse clips 1030 can be connected to a voltage source via member 1010 when member 1010 is connected with member 1000. Alternatively, member 1000 can be provided with a cord for electrically connecting it to a voltage source. Similarly, although only two fuse clips 1030 are shown, those skilled in the art will understand that more can be used if desired, as the fuse clips provide a useful and convenient way of connecting the holders 10 and 40 to first and second voltages.

Those skilled in the art will further appreciate that, if members 1000 and 1010 are made of an insulating material, such as PEEK, the members 1000 and 1010 will serve to provide additional safety to an operator by further shielding the assembly 1 from the operator. Doing so reduces the chance that an operator will receive a shock, such as by inadvertently touching a conductive portion of the assembly 1 when a high voltage is connected to it. In addition, the members 1000 and 1010 safeguard the assembly 1 from inadvertent mechanical jolts, such as if an operator accidentally bumps the assembly 1. Doing so reduces the chance of inadvertent damage to the assembly.

Figure 11A:
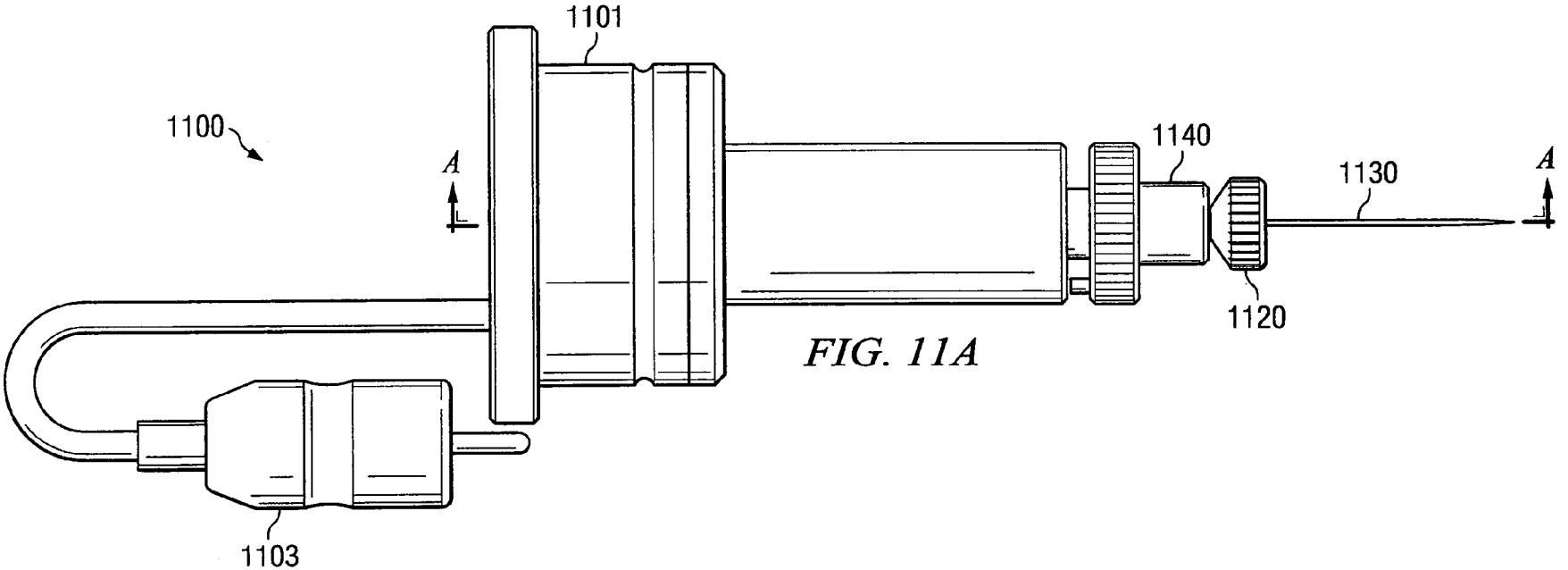
FIG. 11A is a view of an alternative embodiment of the present invention and FIG. 11B is a cross-sectional view of the alternative embodiment of FIG. 11A taken along line A—A of FIG. 11A.
Figure 11B:
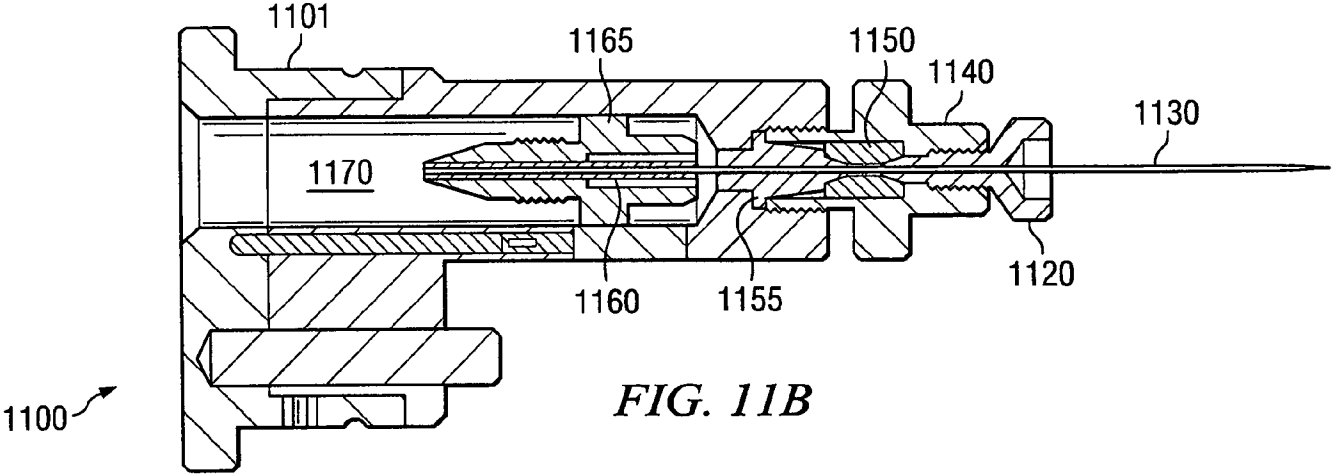

Referring now to FIGS. 11A and 11B, an alternative embodiment of the invention is shown. FIG. 11A shows an assembly 1100 which includes a housing 1101 (from which a cord 1103 adapted for electrically connecting to a power or voltage source extends). The housing 1101 is made of an insulating material such as PEEK. The housing 1101 has two ends. At one end, the housing 1101 includes an opening to a recess 1170 (as shown in FIG. 11B). The housing 1101 and the opening and recess 1170 can be adapted to receive a column for liquid chromatography (not shown). A tube 1130 with a tapered end (such as a syringe or needle shape) extends from the other end of the housing 1101. The tube 1130 can be of the same materials and size as tube 25 discussed above. As shown in FIGS. 11A and 11B, the tube 1130 is removably secured in the assembly 1100 by means of a fitting 1120. The fitting 1120 and the conductive holder 1140 each have threaded portions adapted to removably engage one another. Located within a recess in holder 1140 is a conductive union 1150. The union 1150 and holder 1140 can be of the same type and material as described above with respect to holder 10 and union 20, for example. As also shown in FIG. 11B, a tube 1160 is located at least partially within the body of housing 1101. One end of the tube 1160 is removably attached to one end of the union 1150 by a ferrule 1155, which is removably secured to the housing 1101 by a nut or other appropriate means. The other end of tube 1160 can be removably attached to a fluid source (not shown), such as by threading fitting 1165 into a threaded end of the fluid source (not shown) adapted to receive the fitting

1165. When assembled as shown in FIGS. 11A and 11B, the assembly 1100 allows fluid communication from the first end of the tube 1160 (which, as noted, can be attached to a fluid or effluent source such as a liquid chromatography column) through union 1150 and then through tube 1130 so that the fluid sprays out of the needle-shaped tip or other exit orifice of the tube 1130. The housing 1101 provides for an electrical connection from the cord 1103 to the conductive holder 1140 and conductive union 1150. This allows a selected electrical potential to be applied to the fluid as it passes through the housing 1101, as the voltage travels through the holder 1140 and the union 1150. By making the housing 1101 of PEEK, the operator is potentially exposed to a voltage only via contact with the holder 1140 or, if the tube 1130 is made of metal or has a conductive coating thereon, tube 1130. Thus, housing 1101 provides a measure of protection against electric shock.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. An apparatus for providing a voltage differential to a fluid for an electrospray application comprising:

a first tube;

a first conductive junction having first and second ends, wherein the first end of the first conductive junction is in fluid communication with one end of the first tube, and said first junction is adapted to apply a first voltage to a fluid flowing therethrough;

an insulating connector having a fused silica capillary tube located at least partially therein and wherein the capillary tube has two ends and a first of the ends of the capillary tube is in fluid communication with the second end of the first conductive junction;

a second conductive junction having first and second ends, wherein the first end of the second conductive junction is in fluid communication with the second end of the capillary tube, and said second junction is adapted to apply a second voltage to the fluid; and a second tube having a first end and a second end wherein the first end of the tube is in fluid communication with the second end of the second conductive junction and the second end of the tube is tapered.

2. The apparatus according to claim 1 wherein the capillary tube comprises a column for separating constituents of a sample solution.

3. The apparatus according to claim 1 wherein the first voltage is about zero volts.

4. The apparatus according to claim 1 wherein the second voltage is at least about 3000 volts.

5. The apparatus according to claim 1 wherein the second voltage is at least about 5000 volts.

6. The apparatus according to claim 1 wherein the second voltage is in the range from about 3000 volts to about 8000 volts.

7. The apparatus according to claim 1 wherein the capillary tube consists essentially of a fused silica capillary tube.

8. The apparatus according to claim 1 wherein the first conductive junction comprises a conductive metal.

9. The apparatus according to claim 1 wherein the first conductive junction comprises stainless steel.

10. The apparatus according to claims 1 wherein at least a portion of the first conductive junction in fluid communication with the capillary tube comprises gold plating.

11. The apparatus according to claims 1 wherein at least a portion of the first conductive junction in fluid communication with the capillary tube comprises platinum plating.

12. The apparatus according to claim 1 wherein the insulator comprises polyetheretherketone.

13. The apparatus according to claim 1 further comprising:

means for removably securing one end of the first tube to the first end of the first conductive junction;

means for removably securing the second end of the first conductive junction to the first end of the capillary tube;

means for removably securing the second end of the capillary tube to the first end of the second conductive junction; and means for removably securing the second end of the second conductive junction to one end of a second tube having a tapered distal end, thereby allowing fluid communication from the first tube to the tapered distal end of the second tube substantially along an axis.

14. An apparatus according to claim 1 wherein the first junction is located within a first conductive holder which is at a first selected voltage and wherein the first junction is electrically connected to the first conductive holder.

15. An apparatus according to claim 14 wherein the first holder comprises a unitary piece.

16. An apparatus according to claim 1 wherein the second junction is located within a second conductive holder which is at a second selected voltage and wherein the second junction is electrically connected to the second holder.

17. An apparatus according to claim 16 wherein the second holder comprises a unitary piece.

18. A method of performing mass spectrometry using the apparatus of claim 1 wherein an effluent is sprayed from the second end of the second tube to a collector for analyzing the effluent.

19. A method for providing an electrospray of an effluent, comprising the steps of:

providing an effluent to be analyzed through a first tube;

passing the effluent through a first conductive union at a first selected voltage, wherein the first conductive union is removably connected to the first tube and the effluent passes through a passageway in the first conductive union;

passing the effluent through a second conductive union at a second selected voltage, wherein the second conductive union is in fluid communication with the first conductive union and the effluent passes through a passageway in the second conductive union; and passing the effluent through a second tube having a tapered end, wherein the second tube is removably connected to the second conductive union and the effluent is sprayed from the tapered end of the tube.

20. The method according to claim 19 wherein the effluent passes from the first conductive union to a first end of a third tube in an electrically insulated connector that has a first end removably connected to the first conductive union and the effluent passes from a second end of the third tube to the second conductive union.

21. The method according to claim 19 wherein the effluent is electrically charged when it passes through the passageway of the second conductive union.

22. The method according to claim 21 wherein the first union is located at least partially within a first holder which is electrically grounded and the second union is located at least partially within a second holder which is electrically connected to a power source.

23. The method according to claim 22 wherein the third tube comprises a material selected for separating materials within the effluent.

24. An apparatus for providing an electrospray of an effluent, comprising:

a first tube with a passageway for an effluent and having a first end in fluid communication with an effluent source;

a first conductive holder at a first selected voltage with a first conductive union located within the first holder and electrically connected to the first holder, and having first and second ends, wherein the first end of the first tube is removably attached to the first holder allowing fluid communication from the first tube through the first union;

an insulating connector having first and second ends and having a fused silica capillary tube at least partially disposed therein, wherein a first end of the connector is removably attached to a second end of the first holder allowing fluid communication from the first union through the capillary tube;

a second conductive holder at a second selected voltage with a second conductive union located at least partially within the second holder and electrically connected to the second holder, and having first and second ends, wherein the first end of the second holder is removably attached to the second end of the connector allowing fluid communication from the capillary tube through the second union; and a second tube having a first end and a second tapered end, wherein the first end of the second tube is removably connected to the second end of the second holder allowing fluid communication from the second union to the first end of the second tube and wherein the effluent is sprayed from the tapered end of the tube at the second selected voltage.

* * * * *